United States Patent [19]

El-Shazly et al.

[11] 4,337,091

[45] Jun. 29, 1982

[54] ELECTROLESS GOLD PLATING

[75] Inventors: Mohamed F. El-Shazly, Bloomfield; Kenneth D. Baker, Bridgewater, both of N.J.

[73] Assignee: Hooker Chemicals & Plastics Corp., Warren, Mich.

[21] Appl. No.: 246,472

[22] Filed: Mar. 23, 1981

[51] Int. Cl.[3] ..... C23C 3/02

[52] U.S. Cl. ..... 106/1.23; 106/1.26; 427/304; 427/437; 427/443.1

[58] Field of Search ..... 106/1.23, 1.26; 427/437, 443.1

[56] References Cited

U.S. PATENT DOCUMENTS

| | | | |
|---|---|---|---|
| 3,589,916 | 6/1971 | McCormack | 106/1.23 |
| 3,697,296 | 10/1972 | Bellis | 106/1.23 |
| 3,700,469 | 10/1972 | Okinaka | 106/1.23 |
| 3,917,885 | 11/1975 | Baker | 106/1.23 |
| 4,142,902 | 3/1979 | Burke et al. | 106/1.23 |

OTHER PUBLICATIONS

Okinaka et al., *Plating*, 57, 914 (1970).

Okinaka et al., *Plating*, 58, 1080 (1971).

*Primary Examiner*—Lorenzo B. Hayes

*Attorney, Agent, or Firm*—Richard P. Mueller; Arthur E. Kluegel

[57] ABSTRACT

Improved electroless or autocatalytic gold plating baths wherein the gold ingredient is a water soluble trivalent gold component selected from an alkali metal auricyanide, an alkali metal aurihydroxide, and an alkali metal aurate. The bath contains an amino borane, an alkali metal borohydride, or an alkali metal cyanoborohydride as the reducing agent; an alkaline agent such as an alkali metal hydroxide; and an alkaline buffering agent. Optionally, the bath may contain added alkali metal cyanide. The method of utilizing such electroless or autocatalytic plating bath for depositing gold on metallic substrates such as gold, copper, copper alloys, electroless copper, electroless nickel, nickel, nickel alloys, etc. and on a non-metallic substrates is also described and claimed.

22 Claims, No Drawings

ELECTROLESS GOLD PLATING

FIELD OF THE INVENTION

The present invention relates to the electroless or autocatalyic deposition of gold on substrates; and more particularly to the use of special electroless plating bath for depositing gold on metallic and non-metallic substrates.

BACKGROUND OF THE INVENTION

In recent years a fairly substantial literature has developed with respect to the electroless method of gold plating on surfaces. U.S. patents of special interest both as to the electroless gold plating method and the problems associated with this procedure include; U.S. Pat. Nos. 3,589,916 (McCormack); 3,697,296 (Bellis); 3,700,469 (Okinaka); 3,917,885 (Baker); as well as the earlier patents and articles cited therein. Relevant articles include: Rich, D. W., Proc. American Electroplating Society, 58 (1971); Y. Okinaka, Plating 57, 914 (1970); and Y. Okinaka and C. Wolowodink, Plating, 58, 1080 (1971). This body of literature is pertinent to the present invention insofar as it discloses alkali metal cyanides as the source of the gold or related metal in the electroless bath as well as the use of alkali metal borohydrides and amine boranes as reducing agents. Thus, for example, the 1970 article by Okinaka as well as his U.S. Pat. No. 3,700,469 describes an electroless gold plating bath having the following ingredients.

(1) soluble alkali metal gold complex;

(2) excess free cyanide such as potassium cyanide;

(3) An alkaline agent such as potassium hydroxide; and (4) a borohydride or an amine borane.

The 1971 article by Okinaka et al as well as Baker's U.S. Pat. No. 3,917,885 point out the problems associated with the use of these particular plating baths, particularly when the cyanide concentrations increased. Other problems were encountered when bath replenishment was carried out and the baths became unstable when a plating rate of about 2.5 microns was approached. The need to avoid undesirable gold precipitation from the baths is also noted.

In U.S. Pat. No. 3,917,885 the problems noted above were overcome by utilizing, as the gold or related metals source, an alkali metal imide complex formed from certain special imides. In order to maintain the electroless gold plating at the desired pH of about 11 to 14, the Baker patent suggests the addition to the bath of alkali metal buffering salts such as the citrates, etc. The need to utilize special imides in preparing the gold imide complex is an obvious commercial disadvantage.

OBJECTS OF THE INVENTION

One object of the present invention is to provide an electroless or autocatalytic gold plating bath which avoids the problems and disadvantages of the bath heretofore proposed.

Another object of the present invention is to provide an electroless or autocatalytic gold plating bath which will readily deposit gold on gold as well as on a variety of metallic and non-metallic substrates with good adhesion.

A further object of the present invention is to provide an electroless or autocatalytic gold plating bath which will readily deposit ductile, lemon yellow pure gold on substrates at a desirable rate and in commercial thicknesses.

A still further object of the present invention is to provide a stable electroless or autocatalytic gold plating bath that can be effectively replenished.

These and other objects will become readily apparent from the following description of the invention.

SUMMARY OF THE INVENTION

In accordance with the present invention it has now been found that a substantially improved electroless or autocatalytic gold plating bath and gold plating procedure can be achieved by utilizing a trivalent gold metal complex or compound such as alkali metal auricyanides, alkali metal aurates or alkali metal aurihydroxides as the source of the gold in the plating bath. More particularly, the present invention pertains to autocatalytic baths and procedures, i.e. where the gold can be plated on gold as well as on other suitably treated metallic or non-metallic substrates. Thus, the term "electroless" as used in this specification is intended to encompass autocatalytic plating.

The electroless plating baths of this invention will also contain a suitable reducing agent such as an amino borane or an alkali metal borohydride or cyanoborohydride. The baths will be at a pH of from about 10 to 13 and may contain additional ingredients to obtain and/or maintain, this pH, including an alkaline agent, such as an alkali metal hydroxide and a buffering agent, such as an alkali metal citrate. A further optional ingredient to improve bath stability, is an alkali metal cyanide.

In most operations the electroless plating bath of the present invention will be operated at a plating temperature of from about 50 degrees up to a temperature at which the bath decomposes. Typically the operating temperatures will be from about 50 degrees C. to 95 degrees C., and preferably from about 60 degrees to 85 degrees C.

The substrates to be plated in accordance with the teachings of this invention are preferably metals such as gold, copper, etc. No special pretreatments are required for these metal substrates. Additionally, non-metallic substrates may also be plated. Such substrate will, of course, be subjected to appropriate pretreatments, as are known in the art, before plating.

This invention also provides for replenishing the electroless plating bath with an alkali metal aurate or aurihydroxide solution to maintain the desire gold concentration of the bath. Additional alkaline agent and reducing agent may also be added during replenishment of the bath without encountering any untoward results.

In accordance with another aspect of the present invention an improved electroless gold plating method is provided which leads to results which heretofore were either difficult or impossible to achieve. Such results include higher plating rates with improved bath stability.

DETAILED DESCRIPTION OF THE INVENTION

As previously described, one of the essential features of the present invention is to employ, as the source of gold in the electroless plating bath, a water soluble gold complex or compound wherein the gold ion is in the trivalent state. This is in contrast to the prior art teachings of using complexes where the gold is in the monovalent state such as, for example, potassium aurocyanide. In the present invention, the trivalent gold complex or compound is an alkali metal auricyanide, an alkali metal aurate or an alkali metal aurihydroxide, with the preferred materials being the alkali metal auricyanides and alkali metal aurates. For most purposes the alkali metal is typically either potassium or sodium, and the use of potassium as the alkali metal is especially preferred. Thus, potassium auricyanide, $KAu(CN)_4$, and potassium aurate are preferably utilized in formulating the electroless gold plating baths of the present invention.

The reasons why the trivalent gold functions better than monovalent gold in these plating baths and in this autocatalytic plating process are not fully understood at this time. One possible explanation may be that the oxidation reduction process involving the amino boranes or the borohydrides results in a three electron transfer, which can be achieved more readily by trivalent gold which in turn results in bath stability. The overall reaction may be written as follows:

$$(CH_3)_2NH{:}BH_3+3OH^- \rightarrow BO_2^-+(CH_3)_2NH+2H_2+H_2O+3e^-$$

$$(Au(CH)_4)^-+3e^- \rightarrow Au^\circ+4CH^-.$$

It will be understood that the alkali metal gold cyanides employed in the practice of this invention are water-soluble. However, a variety of compounds which can provide the gold constituent in the trivalent state may be employed in formulating the baths.

The reducing agents employed in connection with the present electroless plating baths include any of the borohydrides, cyanoborohydrides or amine boranes which are soluble and stable in aqueous solution. Thus, alkali metal borohydrides, preferably sodium and potassium borohydrides are utilized, although various substituted borohydrides, such as sodium or potassium trimethoxyborohydride, $Na(K)B(OCH_3)_3H$, may also be employed. Also preferred are the amine boranes such as mono- and di- lower alkyl, e.g. up to $C_6$ alkyl amine boranes, preferably isopropyl amine borane and dimethylamine borane.

It is also essential that the electroless plating baths of the present invention be maintained at a pH of between about 10 and 13 in order to achieve the desired results. It is thus preferred that an alkali metal hydroxide, such as sodium or potassium hydroxide be employed to maintain the pH at this level. However, pH control is considerably easier when alkali metal buffering salts are employed in addition to the alkali metal hydroxide. Suitable alkali metal buffering salts include the alkali metal phosphates, citrates, tartrates, borates, metaborates, etc. Specifically, the alkali metal buffering salts may thus include sodium or potassium phosphate, potassium pyrophosphate, sodium or potassium citrate, sodium potassium tartrate, sodium or potassium borate, sodium or potassium metaborate, etc. The preferred alkali metal buffering salts are sodium or potassium citrate and sodium or potassium tartrate.

In order to further improve the electroless plating baths of this invention, it is desirable in some instances to provide further chelating capacity by the addition of an organic chelating agent such as ethylenediamine tetraacetic acid, and the di-sodium, tri-sodium and tetra-sodium and potassium salts of ethylenediamine tetraacetic acid, di-ethylene triamine pentacetic acid, nitrilotriacetic acid. The ethylenediamine tetraacetic acid, and its di-, tri-, and tetra-sodium salts are the preferred chelating agents, with the tri- and tetra-sodium salts being particularly preferred.

In addition to the foregoing ingredients, the electroless plating baths of this invention may also contain alkali metal cyanides, and more particularly the potassium or sodium cyanides. Such ingredients are added when greater stability for the autocatalytic process is required. When employed, the amount of alkali metal cyanide may range from about 1 to 30 grams per liter, which is far in excess of the minor critical amounts employed by McCormack, which at a maximum are 500 milligrams per liter.

In the electroless plating baths of the present invention, the gold compound or complex, as described, will be present in an amount at least sufficient to deposit gold on the substrate to be plated, up to its maximum solubility in the plating bath. The reducing agent is present in an amount at least sufficient to reduce the gold, up to its maximum solubility in the bath. The alkaline agent and buffering agent are each present in an amount sufficient to provide and maintain the desired bath pH.

More specifically, the components of the electroless plating baths of this invention will be present in amounts within the following ranges:

| Components | Amounts grams/liter Typical | Preferred |
|---|---|---|
| (1) Gold, as the alkali metal auricyanide, aurate or aurihydroxide | 0.5–6.0 | 2.5–5.0 |
| (2) Reducing agent, as amino borane, alkali metal borohydride or cyanoborohydride | 1–6 | 2–5 |
| (3) Alkaline agent | 10–90 | 20–50 |
| (4) Buffering agent, as alkali metal salt | 15–40 | 20–30 |
| (5) Alkali metal cyanide (when present) | 1–30 | 1–15 |
| (6) Organic chelating agent (when present) | 2–25 | 3–15 |
| (7) Water | To make one liter | |

As previously set forth, the pH of the bath is maintained at a range of about 10 to 13. The typical operational temperature during plating is from about 50 degrees to 95 degrees C., preferably from 60 to 85 degrees. For most purposes, the plating rates will be up to 8 microns per hour; preferably at least about 2 microns per hour.

Although this invention has been described above primarily in conjunction with electroless gold baths, it should be understood that one or more alloying metals such as copper, zinc, indium, tin, etc. may also be added to the electroless baths. Where these are employed, they are added to the bath as a suitable soluble salt in amounts sufficient to provide up to about 20 percent by weight of the alloying metal or metals in the gold deposit.

In accordance with the preferred features of the present invention the substrates to be plated by the electroless gold baths are metals such as gold, copper, copper alloy, electroless copper, nickel, electroless nickel, nickel alloys, and the like. Thus, where a metallic substrate is employed, such surfaces include all metals which are catalytic to the reduction of the metal cations dissolved in the described baths. While it therefore may in some cases be preferred to further sensitize the substrate by treatments well known to those skilled in this art, the use of nickel, cobalt, iron, steel, palladium, platinum, copper, brass, manganese, chromium, molybdenum, tungsten, titanium, tin, silver, etc. as metal substrates upon which the gold is to be plated are possible.

With the use of non-metallic substrates, however, these surfaces must be rendered catalytically active by producing a film of particles of catalytic material thereon. This may be done by the method described in U.S. Pat. No. 3,589,916, upon such surfaces as glass, ceramics, various plastics, etc. Preferably, when a plastic substrate is to be plated according to the present invention, it is initially etched, preferably in a solution of chromic and sulfuric acid. After rinsing, the substrate is immersed in an acidic solution of stannous chloride, such as stannous chloride and hydrochloric acid, rinsed with water and then contacted with an acid solution of a precious metal, such as paladium chloride in hydrochloric acid. Subsequently, the now catalytically active non-metallic substrate may be contacted with the electroless plating solutions of this invention in order to autocatalytically deposit metal plated thereon.

The method of utilizing the present invention involves primarily the immersion of the metallic or non-metallic substrates into the electroless plating baths. These baths are maintained at the pH described above, while the plating is carried out at the aforementioned temperatures. Excellent thickness of gold metal deposits have been achieved without encountering the bath instability and other problems of certain prior art processes. Commercially acceptable adhesion was also readily achieved by the practice of the present invention.

A still further aspect of the present invention is the ability to replenish the bath without encountering difficulties. It has been found, for example, that aside from adding additional alkaline agent, such as potassium hydroxide, and reducing agent, replenishment of the trivalent gold content may be accomplished by adding an alkali metal aurihydroxide or alkali metal aurate to the bath. This replenishment of the bath with water-soluble components is accomplished without adverse effect on either the bath plating rate or the bath stability.

DESCRIPTION OF THE PREFERRED EMBODIMENTS

The invention will be more fully understood by reference to the following illustrative embodiments.

EXAMPLE I

An electroless plating bath was formulated from the ingredients set forth below:

| Ingredients | Amount, g/l |
|---|---|
| Gold, as $KAu(CN)_4$ | 4 |
| Potassium Hydroxide | 35 |
| Tripotassium Citrate | 30 |
| Dimethyl Amino Borane | 5 |

The pH of the resulting bath was about 11.5 to 13.

The bath was used to plate gold on gold, copper, and copper alloys (48 square inches per liter), at 80 degrees C. The plating rate was 4 microns/hour. Deposits from this bath were ductile, lemon yellow, pure gold with excellent adhesion to the substrates.

During a number of runs the bath was replenished by the addition of potassium aurihydroxide, potassium hydroxide, and dimethylamino borane.

EXAMPLE II

An electroless plating bath was formulated as follows:

| Ingredients | Amount, g/l |
|---|---|
| Gold, as $KAuO_2$ | 5 |
| Potassium Cyanide | 15 |
| Potassium Hydroxide | 25 |
| Dimethyl Amino Borane | 3 |

Deposits were obtained on copper and copper alloys at a plating rate approaching 2.5 microns per hour with the bath at a temperature of 85° C.

EXAMPLE III

Another electroless plating bath was formulated as follows:

| Ingredients | Amount, g/l |
|---|---|
| Gold, as $KAu(CN)_4$ | 3 |
| Potassium Cyanide | 10 |
| Potassium Hydroxide | 10 |
| Potassium Borohydride | 1 |

Deposits were obtained on gold at a rate of 2.0 microns per hour.

EXAMPLE IV

In this run a non-metallic substrate was to be plated. The following procedure was employed:

(1) An ABS plastic substrate was etched by a chromic acid/sulphuric acid etch;
(2) The substrate was rinsed in cold, running water and the chromic acid was neutralized with sodium sulphate;
(3) The substrate was again rinsed in water and activated in a stannous chloride/hydrochloride sol.;
(4) The substrate was rinsed once again in water and immersed in a $PdCl_2$/HCl sol.;
(5) The substrate was given a further rinse with water; and
(6) The resulting activated ABS plastic substrate was immersed in the electroless plating bath of Example I, whereby an excellent electroless gold plating on the plastic substrate was achieved.

EXAMPLE V

The electroless plating baths of Examples I, II and III were effectively replenished with potassium aurate at 20% depletion so as to provide consistent deposition rates.

Similar results are obtained in the proceeding Examples I, II, and III when potassium cyanoborohydried is used as the reducing agent.

The above data show that the electroless bath of this invention leads to improved results and avoids the problems or the commercial disadvantages associated with the previously proposed electroless gold metal baths.

It will be further understood that the foregoing examples are illustrative only, and that the variations and modifications may be made without departing from the scope of this invention.

What is claimed is:

1. An aqueous electroless gold plating bath comprising a water-soluble, trivalent gold component selected from the group consisting of alkali metal auricyanides, alkali metal aurates and alkali metal aurihydroxides and a reducing agent selected from the group consisting of alkylamino boranes, alkali metal borohydrides and alkali metal cyanoborohydrides, the gold component being present in an amount at least sufficient to deposit gold on the substrate to be plated and the reducing agent being present in an amount at least sufficient to reduce the gold in the bath, which plating bath has a pH within the range of about 10 to 13.

2. The electrodes gold plating bath of claim 1, wherein there is also included an alkaline agent and an alkaline buffering agent in amounts sufficient to maintain the bath pH within the specified ranges.

3. The electrodes gold plating bath of claim 2, wherein the pH is maintained within the range of about 11 to 13.

4. The electroless gold plating bath of claim 2, wherein the reducing agent is a dialkylamine borane.

5. The electroless gold plating bath of claim 4, wherein the dialkylamino borane is dimethylamino borane.

6. The electroless gold plating bath of claim 1, wherein the reducing agent is an alkali metal borohydride.

7. The electrodes gold plating bath of claim 6, wherein the alkali metal borohydride is potassium borohydride.

8. The electroless gold plating bath of claim 1, wherein said reducing agent is an alkali metal cyanborohydride.

9. The electroless gold plating bath of claim 8, wherein the alkali metal cyanoborohydride is potassium cyanoborohydride.

10. The electroless gold plating bath of claim 2, wherein said alkaline agent is sodium hydroxide or potassium hydroxide.

11. The electrodes gold plating bath of claim 2, wherein said alkaline buffering agent is selected from the group consisting of alkali metal phosphates, citrates, tartrates, borates, metaborates, and mixtures thereof.

12. The electroless gold plating bath of claim 1, wherein from 1 to 30 g/l of an alkali metal cyanide is added as an additional ingredient.

13. The electroless gold plating bath of claim 1, wherein said trivalent gold component is an alkali metal auricyanide.

14. The electroless gold plating bath of claim 13, wherein the alkali metal auricyanide is potassium auricyanide.

15. The electroless gold plating bath of claim 1, wherein said trivalent gold component is an alkali metal aurate.

16. The electroless gold plating bath of claim 15, wherein the alkali metal aurate is potassium aurate.

17. The electroless gold plating bath of claim 1, wherein the trivalent gold component is an alkali metal aurihydroxide.

18. An aqueous electroless gold plating bath having a pH within the range of about 10 to 13 and comprising the following:

| Component | Amount - g/l |
|---|---|
| (a) Trivalent gold, as an alkali metal auricyanide, aurate or aurihydroxide | 0.5 to 6.0 |
| (b) an alkali metal hydroxide | 10 to 90 |
| (c) an alkali metal buffering salt | 15 to 40 |
| (d) an amino borane, an alkali metal borohydride, or an alkali metal cyanoborohydride | 1 to 6 |
| (e) an alkali metal cyanide | 1 to 30 |

19. The electroless gold plating bath of claim 18, wherein the alkali metal is sodium or potassium.

20. The electroless gold plating bath of claim 19, wherein the alkali metal is potassium.

21. The electroless gold plating bath of claim 18, wherein Component (a) is potassium auricyanide; Component (b) is potassium hydroxide; Component (c) is tripotassium citrate; Component (d) is diemethylamino borane; and Component (e) is potassium cyanide.

22. An electroless plating method for plating gold on a substrate which comprises immersing said substrate in the gold plating bath of claims 1, 2, 3, 4, 5, 6, 7, 8, 9, 10, 11, 12, 13, 14, 15, 16, 17, 18, 19, 20 or 21 and maintaining the substrate in said bath for a period sufficient to deposit the desired amount of gold thereon.

* * * * *